United States Patent [19]

Stoev et al.

[11] 4,060,481

[45] Nov. 29, 1977

[54] MATERIAL TREATING APPARATUS INCLUDING PNEUMO-HYDRAULIC VIBRATOR

[75] Inventors: Stoycho Mitrev Stoev; Metodi Stoyanov Metodiev; Lyubomir Vladimirov Kuzev; Petko Georgiev Vedrichkov; Ivan Mitrev Sapunarov; Vassil Vladimirov Vassilev; Spas Petkov Dimitrov; Vihar Assenov Gasharov; Sheko Kolev Russev; Kostadin Georgiev Mitrev, all of Sofia, Bulgaria

[73] Assignee: Vish Minno-Geoloshki Institute - NIS, Sofia, Bulgaria

[21] Appl. No.: 688,267

[22] Filed: May 20, 1976

Related U.S. Application Data

[62] Division of Ser. No. 572,457, April 28, 1975, abandoned.

[30] Foreign Application Priority Data

Feb. 19, 1974 Bulgaria ..... 25837

[51] Int. Cl.[2] ..... B03D 1/24

[52] U.S. Cl. ..... 209/170

[58] Field of Search ..... 209/425, 426, 427, 455–457, 209/500, 168, 170

[56] References Cited

U.S. PATENT DOCUMENTS

| | | | |
|---|---|---|---|
| 2,124,983 | 7/1938 | Martin | 209/455 X |
| 2,426,337 | 8/1947 | Bird | 209/426 X |
| 2,497,339 | 2/1950 | Bastanchury | 209/469 |

*Primary Examiner*—William A. Cuchlinski, Jr.

[57] ABSTRACT

Material treating apparatus including one or more pneumohydraulic vibrators. The apparatus includes a container with cells separated by at least one valve lying on a supporting frame, the valve having a movable valve element which is urged toward its valve-closed position by springs. On one side of the valve there is an air cell connected with a source of air under pressure, and on the other side of the valve there is a second cell containing a liquid or a liquid suspension of material to be treated. When the air cell is subjected to air under pressure the movable valve element vibrates and generates intensive vibro-pulsation turbulent streams in the liquid material in the second cell.

1 Claim, 5 Drawing Figures

Fig. 1
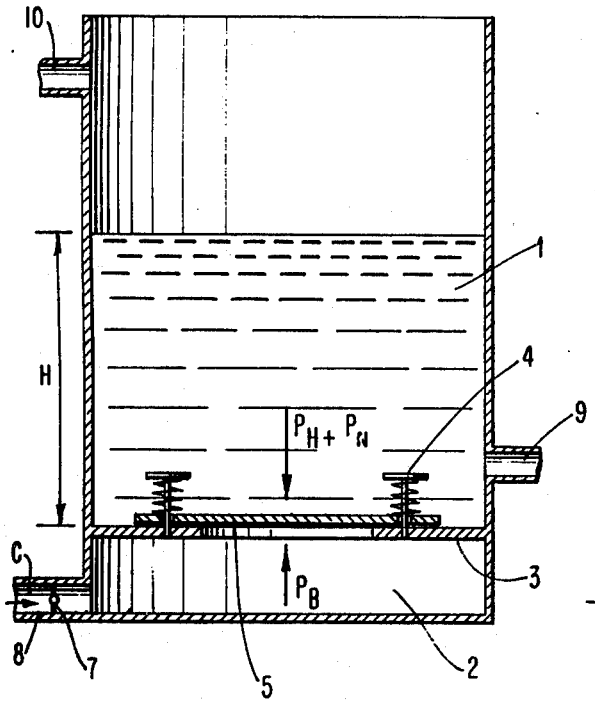
Fig. 2
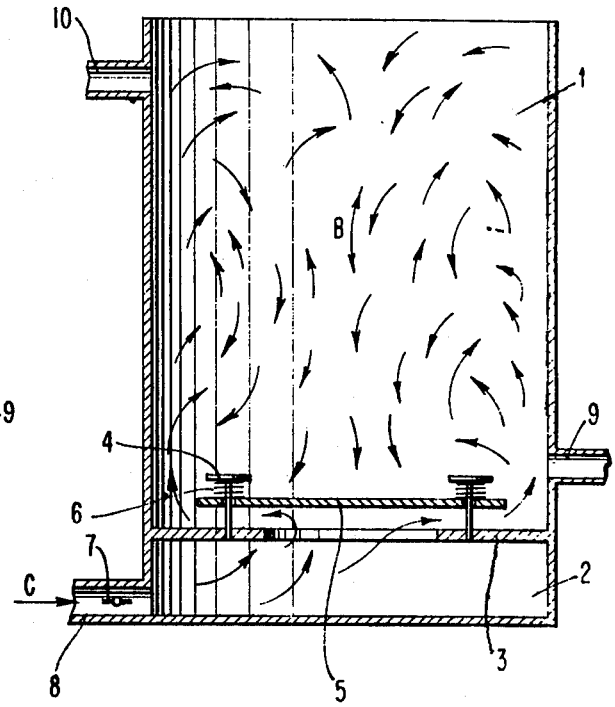
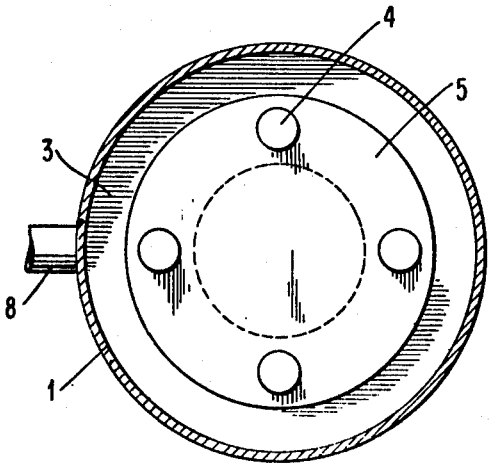
Fig. 3
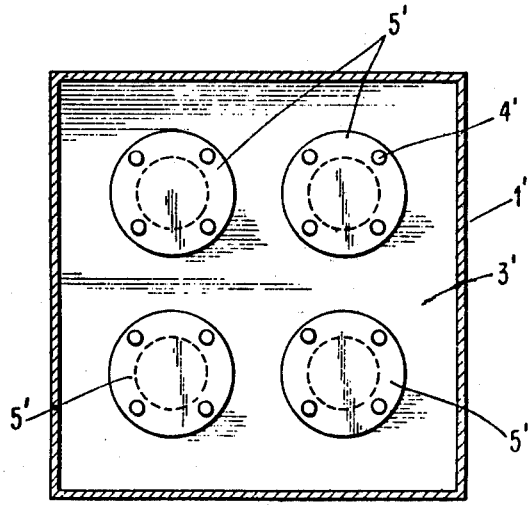
Fig. 4

MATERIAL TREATING APPARATUS INCLUDING PNEUMO-HYDRAULIC VIBRATOR

This is a division of application Ser. No. 572,457 filed Apr. 28, 1975 now abandoned.

This invention relates to material treating apparatus including at least one pneumo-vibrator for generating intensive vibro-pulsation turbulent streams in a liquid or a liquid-solid material suspension to be treated.

During the last few years a number of vibrator constructions have been developed in order to intensify production processes including the treatment of liquids or liquid-solid material suspensions. In some cases these known constructions contribute to a considerable increase of the efficiency of the technologies employed in the material treating process. Their disadvantage is that they involve vibrators, which makes the construction of the apparatus more expensive, and involves maintenance of the vibrators. When intensive vibrating is necessary, presently available vibrators are used in order to obtain the required effect. However, there are some technologies which cannot be intensified by the use of low intensity vibrations. Some processes are known, on the other hand, in which intensive vibration should not be applied. Thus, attempts to construct washing machines for household appliances using intensive vibrations proved unsuccessful because of the breaking of the vessels.

The present invention has among its objects the provision of a penumo-hydraulic vibrator of simple construction which allows the generation of intensive vibro-pulsation turbulent streams, such vibrator being reliable in operation and simple to maintain. The vibrator of the invention is operated by either compressed air or sucked air, that is, air under reduced pressure; such air is often necessary for a given process. The pneumo-hydraulic vibrator devices based on these principles are called "self-vibration vibrators".

A number of embodiments of material treating apparatus of the invention, such embodiments including the pneumo-hydraulic vibrator of the invention, are shown in the accompanying drawings, in which:

FIG. 1 is a view in vertical cross section through a working cell provided with a pneumo-hydraulic self-vibrating device in accordance with the invention, the valve element of the vibrating device being shown in closed position;

FIG. 2 is a view similar to FIG. 1 but with the valve element of the vibrating device being shown in open position, FIG. 3 is a view in plan of the valve of FIGS. 1 and 2;

FIG. 4 is a view in plan of a support adapted to divide an air cell from a liquid or liquid-solid suspension material treating cell, such support carrying four valves similar to that shown in FIG. 3;

Figure 5:
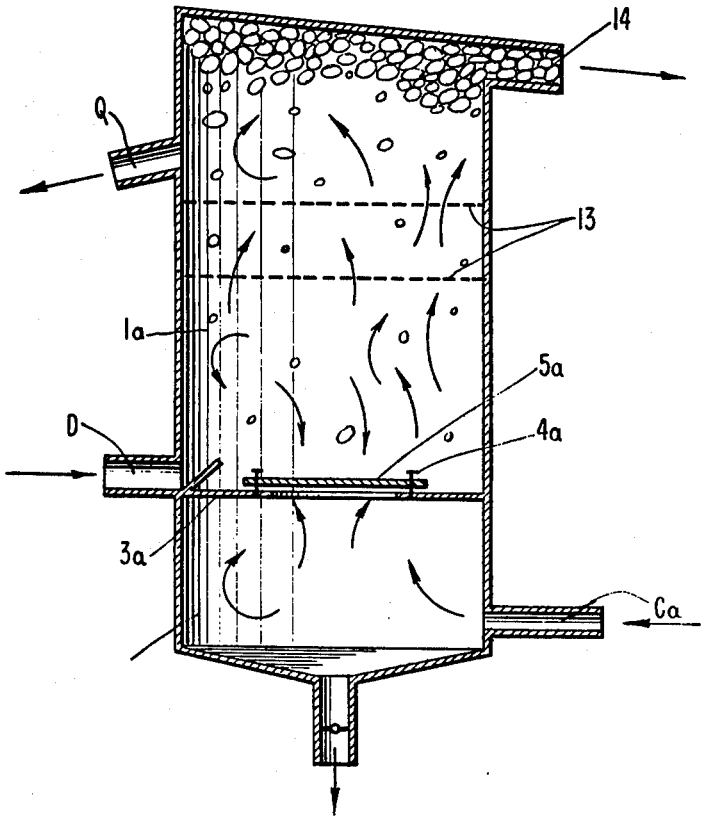
FIG. 5 is a schematic view in vertical cross section through a further embodiment of apparatus in accordance with the invention, such apparatus being adapted to pneumatic self-vibration flotation.

FIGS. 1 and 2 illustrate the principle and manner of operation of the pneumo-hydraulic self-vibrating device of the invention. A working cell 1 in the form of a tank containing liquid is disposed above an air cell 2 into which compressed air, designated C, enters through a conduit means 8 having a pressure regulating valve 7 interposed therein. At the top of the air cell 2 there are horizontal supporting members 3 which are disposed in the same plane and extend inwardly of the cell from the side walls thereof. The space between the supports 3 is spanned by a play-like movable valve element 5 which is mounted on vertical adjustable guide screws 4 which pass freely through holes in the valve element 5. Coil compression springs 6, which extend between the valve element 5 and heads on the screw guides 4 constantly urge the element 5 toward the closed position thereof shown in FIG. 1. Liquid or a liquid-solid material suspension is introduced into the top of the working cell 1 through conduit means 10 and is exhausted therefrom in the bottom thereof by a discharge conduit means 9.

Guiding screws 4 can be screwed into threaded openings in the supporting frame members 3. When the valve 7 is shut, the valve element 5 is pressed toward the opening between the supporting members 3 by the hydrostatic pressure of the liquid in the working cell 1 and the pressure of the spring 6 acting thereon. Increasing of the liquid volume obviously leads to increasing the height thereof, and therefore the pressing force defined by the hydrostatic pressure $P_H$. By means of the screws 4, the second component of the pressing force $P_S$ can be changed as a result of the change in the degree of compression of the springs; this also changes the length of the path through which the valve element 5 may move between the supports 3 and the heads of the screws 4.

Upon the opening of the valve 7 the air pressure in the air cell 2 rises and as soon as the force $P_B$ which is dependent upon it and which acts upon the valve becomes greater than $P_H + P_S$, the valve element 5 is raised and releases air through the gap formed between the valve element and the supporting frame members 3. As the valve element 5 moves upwardly, the liquid beneath the valve in the liquid between the valve and the container walls are pushed upwardly in a vertical direction due to the entering of air from the cell and the formation of air-lift conditions. After a certain quantity of air has escaped through the open valve, the pressure in the air cell 2 drops and the valve element 5, under the action of the pressing force, descends into the position thereof shown in FIG. 1 so as to stop the escape of air from the air cell 2 into the working cell 1. Obviously the whole quantity of liquid, due to its own weight, moves downwardly.

This cycle is repeated because of the again rising air-pressure in the air cell. The repeating of the cycle, i.e., the frequency of vibration depends upon the value of the pressing force. This is why the frequency can be controlled by changing the height H of the liquid in the working cell and the compressive force of the springs 6. As a result of the vibration of the valve element 5 and the periodic escape of air from the air cell 2 into the working cell 1, conditions for effective turbulence in the liquid occur in the working cell. This can considerably increase the mass and heat transfer between various parts of the liquid. The container which forms the working cell 1 and the air cell 2 may be of a variety of shapes. The number of valves having valve elements 5 also can vary and is determined by the horizontal area of the working cell.

In FIG. 3 there is shown a working cell 1 with a round horizontal cross section, cell 1 being provided with one valve having a valve element 5. In FIG. 4 there is shown a rectangular cell 1′ which is provided with four valves having valve elements 5′ mounted on adjusting screws 4 which in turn are secured to a square plate 3′ which is of the same shape as the horizontal section of the cell 1'. The construction of the valve with valve element 5 which is shown in FIGS. 1 and 2 can be simplified by the removal of the spring 6. The hydrostatic force exerted by the liquid in the working cell is usually enough to attain an effective frequency and amplitude of the vibrations of the valve element 5.

The above-described pneumo-hydraulic vibrator can be used for solving a number of problems in the laboratory, as well as industrial and domestic problems, connected with heat and mass transfer. The vibrator is best illustrated in conjunction with its use in a number of processes now to be described.

Heating or cooling of pulp, liquids or suspensions

A number of processes in mineral processing, chemical and food industries require fast cooling or heating of the liquid products. For example, in the flotation of oxide ores, pulp very often has to be heated before flotation; in the separation of copper-molybdenum ores pulp has to be steamed; in the production of cheese fast cooling after pasteurization is necessary, etc. The pneumo-hydraulic vibrator above described and shown in FIGS. 1 and 2 can be used in all of these processes. It is only necessary to put the feeding pipe 9 at the lower end of the working cell, near to the valve element or elements 5, and to put the discharge pipe 10 at the upper part of the cell. It is possible to provide for opposite directions of the feeding of the air and liquid or liquid suspension. When heating is required, heated air has to be passed through the liquid media, and for cooling, cold air has to be passed through the liquid media. As a practical matter, water practially does not penetrate into the air cell 2. However, if a suspension is treated, when switching off the vibrator some grains may remain between the valve element 5 in the supporting frame member 3. In this case the liquid may penetrate into the air cell, and because of this, it is practical to install a liquid discharge pipe at the bottom of the air cell. The occasional leakage of water into the air cell 2 is not to be considered as a disadvantage, since when the apparatus is switched off, such leak liquid will be supplied to the following step of the process.

Pneumatic self-vibration flotation

A further embodiment of the apparatus for use for the above purpose is shown in FIG. 5. In such figure parts which are generally similar to those shown in FIGS. 1 and 2 are designated by the same reference characters with an added suffix *a*.

Pulp is supplied through an inlet conduit means D, the pulp flowing inwardly and being deflected by an angular baffle to a path of flow above the vibrating valve element 5*a*. Air escaping from the air cell 2*a* through the vibrating valve is intensively mixed with the pulp, thereby increasing the opportunities for contacts between particles and bubbles. Bubbles, with floatable components adhered to them, pass through calming grids 13 and are accumulated for removal through a discharge froth product discharge conduit means 14. The cell product is discharged through a gate device Q for maintaining an optimum level of the pulp in the cell 1*a*.

The advantages of the device are as follows: As compared with mechanical machines it contains no mechanical moving parts. As compared with pneumatic machines, it provides much better conditions for particle-bubble contact. The presence of accoustical waves in the pulp because of its being vibrated by the valve element 5*a* is also an advantage. It has been proved that this contributes to improvement of the selectivity of the apparatus and the increase of its output.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. An apparatus for treating pulp in a liquid, such apparatus having a working cell with opposite vertical walls adapted to contain the liquid and pulp, the improvement which comprises a gas cell disposed at least partially below said working cell, first wall means disposed in said apparatus having at least one aperture separating said working cell and said gas cell, a valve disposed in said aperture and having a valve element disposed above the aperture and normally urged into a closed position by the weight of the liquid, a source of pressurized gas, first conduit means adapted to place said source of pressurized gas in fluid communication with said gas cell, valve means operatively mounted in said first conduit means between said source of pressurized gas and said gas cell and adapted to regulate the pressurized gas flow to said gas cell, the pressurized gas in said gas cell producing intermittently sufficient force to move said valve element upwardly and permit the escape of gas into said working cell and thereby causes a vibration of said valve element, means for guiding the valve element for vertical travel with respect to at least a portion of said wall means, a pair of vertically spaced horizontal grids spanning between said opposite vertical walls of said working cell and being supported by them, and at least two discharge conduit means disposed in one of said vertical walls of said working cell above the uppermost horizontal grid for discharging a froth product from said working cell.

* * * * *